US008128342B2

(12) United States Patent
Dunn et al.

(10) Patent No.: US 8,128,342 B2
(45) Date of Patent: Mar. 6, 2012

(54) MULTIDIRECTIONAL MULTISOUND INFORMATION SYSTEM

(75) Inventors: William Dunn, Alpharetta, GA (US); David Williams, Canton, GA (US); Jerry Fraschilla, Snellville, GA (US)

(73) Assignee: Manufacturing Resources International, Inc., Alpharetta, GA (US)

( * ) Notice: Subject to any disclaimer, the term of this patent is extended or adjusted under 35 U.S.C. 154(b) by 720 days.

(21) Appl. No.: 12/248,255

(22) Filed: Oct. 9, 2008

(65) Prior Publication Data

US 2010/0092005 A1 Apr. 15, 2010

(51) Int. Cl.
*H04R 3/00* (2006.01)

(52) U.S. Cl. ..... 415/111; 415/77; 415/116; 415/190; 415/191

(58) Field of Classification Search ..... 381/77, 381/111, 116, 120, 174, 191; 348/569
See application file for complete search history.

(56) References Cited

U.S. PATENT DOCUMENTS

| | | | | |
|---|---|---|---|---|
| 6,771,785 | B2 | 8/2004 | Pompei | |
| 6,775,388 | B1 | 8/2004 | Pompei | |
| 6,914,991 | B1 | 7/2005 | Pompei | |
| 7,174,029 | B2 | 2/2007 | Agostinelli et al. | |
| 7,204,342 | B2 | 4/2007 | Lee | |
| 2001/0007591 | A1* | 7/2001 | Pompei | 381/111 |
| 2003/0088832 | A1 | 5/2003 | Agostinelli et al. | |
| 2005/0195330 | A1 | 9/2005 | Zacks et al. | |
| 2009/0058845 | A1* | 3/2009 | Fukuda et al. | 345/214 |
| 2010/0195865 | A1* | 8/2010 | Luff | 382/100 |

OTHER PUBLICATIONS

Plasma/LCD Flat Pant Panel Displays, Focused Sound by Dakota Audio, retrieved Sep. 29, 2008, 2 pages, available at: http://datotaaudio.com/web/solutions/plasma_lcd.htm.

Maney, Kevin, Sound technology turns the way you hear on its ear, USA Today, May 19, 2003, 3 pages, available at: http://www.usatoday.com/tech/news/techinnovations/2003-05-19-hss_x.htm.

Focused Mini Array: Model MA-4 Technical Documentation, Focused Sound by Dakota Audio, Sep. 24, 2008, 3 pages, Bismark, North Dakota, available at: www.dakotaaudio.com.

Schwarts, Evan I., The Sound War, Technology Review, May 2004, 8 pages, available at http://www.woodynorris.com/Articles/TechnologyReview.htm.

The Mini Maestro Speaker System Technical Information, Brown Innovations, Inc, retrieved Sep. 29, 2008, available at www.BrownInnovations.com.

Audio Spotlight: Technical Specifications, Holosonic Research Labs, Inc., copyrighted 2007, 1 page, retrieved Sep. 29, 2008, available at: www.holosonics.com.

Cut Through the Noise With HSS H450, American Technology Corporation, retrieved Sep. 26, 2008, 2 pages, San Diego, California.

* cited by examiner

*Primary Examiner* — Dung A. Le
(74) *Attorney, Agent, or Firm* — Standley Law Group LLP

(57) ABSTRACT

Exemplary embodiments provide an information system adapted to focus a plurality of audio messages to a plurality of different locations. As a consumer passes a display, their attention is attracted based on the series of messages. Further, a consumer can obtain more and different information as they change their position. Exemplary embodiments may also display a different image to the consumer depending on the position of the consumer relative to the display. Further embodiments may utilize touch-screen technology to allow a user to select an icon from the screen and obtain further information either through additional messages, video, or both.

15 Claims, 5 Drawing Sheets

MULTIDIRECTIONAL MULTISOUND INFORMATION SYSTEM

CROSS-REFERENCE TO RELATED APPLICATIONS

This application is a non-provisional patent application and does not claim priority to any applications.

TECHNICAL FIELD

Exemplary embodiments relate generally to a system for directing a plurality of different sounds to a plurality of different locations in connection with an information display.

BACKGROUND AND SUMMARY OF EXEMPLARY EMBODIMENTS

In the highly competitive field of consumer advertising, getting the attention of the consumer can sometimes be the most challenging task. The best looking product with the finest advertising is worthless without first getting the attention of the consumer. Traditional advertising displays have come a long way in attracting the consumer. The displays have become bigger, brighter, and may even contain flashing lights, movement, or full motion video. However, these displays have only focused on grabbing the attention of one of the available senses of the consumer, i.e. sight.

More modern displays have begun to mix sound along with the display itself, thus beginning to utilize both sight and hearing. Problems have arisen however, most notably in the form of the 'washing out' of a sound message by ambient noise. Further, there are limitations as to how far away sound can be heard from the display. Recent innovations have created several different 'sound focusing' techniques which allow a desired sound to be focused in a specific area without letting the sound 'bleed' into the surrounding ambient noise. These recent innovations also allow sound to be heard at a relatively large distance from the display, without contributing to an increase in the level of ambient noise of the surrounding environment.

Exemplary embodiments herein utilize recent sound focusing techniques to project several different messages to different positions around a display. Embodiments may project a first message at a very close distance to the display, while a different message is projected at a further distance from the display. Further embodiments may project a first message at a first viewing angle, while a second message is projected at a second viewing angle. Any number of different messages at different positions may be utilized in order to attract the attention of consumers and provide them with information. This information could be advertising information, or could also be any form of information (i.e. flight schedules, train departure times, movie times, menu information, weather conditions, etc.).

The plurality of different messages projected to a plurality of different positions could be used for a number of purposes. First, as the consumer passes the display and hears different messages based on their position, the attention of the consumer is more likely to be drawn towards the display. Therefore, embodiments could be used to attract the attention of passing consumers for the purpose of showing them advertisements or any other type of information. Second, embodiments could be used to provide more/different information to the consumer. For example, a message which is projected at a large distance may be the 'attention grabbing' message such as "Have you seen the newest hybrid car from Company X? It gets 50 miles to the gallon! Come closer for more information." If the consumer decides to approach the display, a second message may provide additional details about the car, including the price, additional features, and the nearest dealer location.

Different messages at different locations can also be utilized to provide different types of messages. For example, if standing in front of the center of the display, the consumer may hear a message such as "Check out the new menu at Antonio's Italian Restaurant. Step to the left to hear the newest menu options. Step to the right to hear directions to the nearest Antonio's Italian Restaurant." Alternatively, the consumer could also hear "Step forward to hear reviews from national Italian cuisine aficionados." Exemplary embodiments may also display a different image to the consumer depending on the position of the consumer relative to the display. Further exemplary embodiments provide a touch screen for interaction with the consumer once they have been attracted towards the display.

The exemplary embodiments herein disclosed are not intended to be exhaustive or to unnecessarily limit the scope of the embodiments. The exemplary embodiments were chosen and described in order to explain the principles so that others skilled in the art may practice the embodiments. Having shown and described exemplary embodiments, those skilled in the art will realize that many variations and modifications may be made to affect the described invention. Many of those variations and modifications will provide the same result and fall within the spirit of the exemplary embodiments. It is the intention, therefore, to limit the embodiments only as indicated by the scope of the claims.

BRIEF DESCRIPTION OF THE DRAWINGS

A better understanding will be obtained from a reading of the following detailed description and the accompanying drawings wherein identical reference characters refer to identical parts and in which.

DETAILED DESCRIPTION OF PREFERRED EMBODIMENTS

Figure 1:
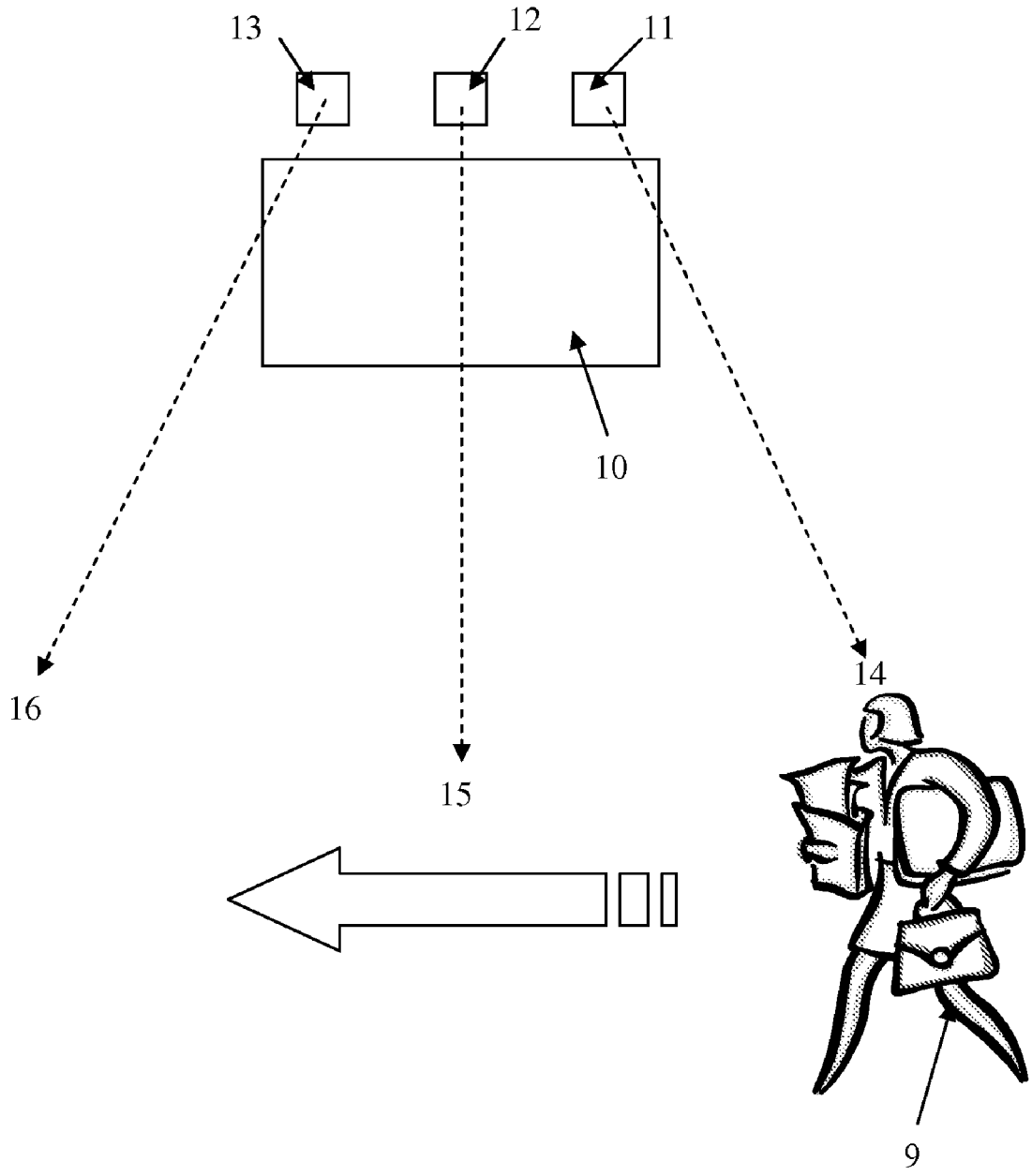
FIG. 1 is a schematic illustration of an embodiment where three different sound messages are projected at three different angles from a display.

The sound focusing techniques in the preferred embodiments may include a parametric audio amplifier system. These systems employ an acoustic transducer for projecting an ultrasonic carrier signal modulated with a processed audio signal through the air for subsequent regeneration of the audio signal along a selected path of projection. A conventional parametric audio amplifier system may include a modulator configured to modulate an ultrasonic carrier signal with a processed audio signal, a driver amplifier configured to amplify the modulated carrier signal, and at least one acoustic transducer configured to project a sonic beam corresponding to the modulated ultrasonic carrier signal through the air along a selected projection path. Because of the nonlinear propagation characteristics of the air, the projected sonic beam is demodulated as it passes through the air to regenerate the audio signal along the selected projection path. These systems are beneficial for focusing sound because the sound is transmitted in an ultrasound frequency (ie. above 20 k Hz) so that they are inaudible unless the listener is located near the desired position. Also, due to the high frequency of the carrier ultrasound wave, the direction of the wave and the desired position can be tightly controlled.

Exemplary parametric audio amplifier systems are commercially available from Holosonic Research Labs, Inc., of Watertown, Mass.; www.holosonics.com. Exemplary models may include the Audio Spotlight® line of products from Holosonic Research Labs. Further exemplary systems are available from American Technology Corporation (ATC), of San Diego, Calif.; www.atcsd.com. Exemplary models from ATC may include the SoundSaber® and the HyperSonic Sound® systems.

Alternatively, the sound focusing techniques in the preferred embodiments may include focused sound solutions from Dakota Audio, of Bismark, N.D.; www.dakotaadio.com. Exemplary models may include the MA-4, FA-603, FA-602, and FA-501. These models use an array of traditional, high-quality loudspeakers where the signals to the speakers may be delayed so that the sound waves propagate and develop in a specific position.

Also, the sound focusing techniques in the preferred embodiments may include focused sound solutions from Brown Innovations, Inc. of Chicago, Ill.; www.browninnovations.com. Exemplary models may include Maestro, Flush-Mount Maestro, MiniMaestro, and the SonicBeam™. These models also use an array of traditional, high-quality loudspeakers and may also utilize a sound dome.

Still further, the sound focusing elements may utilize the sound focusing techniques taught in U.S. Pat. No. 7,204,342 to Lee entitled "Sound Focus Speaker of Gas-Filled Sound Lens Attachment Type." This disclosure is herein incorporated by reference in its entirety.

Note that for projecting sound across large distances the parametric audio amplifier system may be preferred. Additionally, if two positions are relatively close to one another, or many positions are desired, the parametric audio amplifier system may be used for its ability to tightly control the sound projection.

The displays used in the embodiments may be static displays which show only a single image unless manually replaced. The displays could also be a scrolling display which shows different static images by scrolling through several different graphics. The displays could also be a dynamic display such as a light emitting diode (LED) display, liquid crystal display (LCD), plasma display, organic light emitting diode display, or field emitting display (FED). Exemplary displays may also comprise touch-screen displays where the consumer can select different images and/or audio based on selections of icons on the touch-screen.

In FIG. 1, the display 10 is shown with three separate sound focusing devices 11, 12, and 13. As the consumer 9 walks through positions 14, 15, and 16, a sound message may be heard at each position. For example, the sound message heard at position 14 may be a customer testimonial such as "I cannot believe the amazing gas mileage that I'm getting with my new car from Company X!" As the consumer passes position 15 they might hear "Turn right to see the amazing new gas-sipper from Company X, only $24,900!" Finally, another message may be heard as the consumer passes position 16. This message may be another customer testimonial, the location of the nearest Company X, a repeat of one of the previous messages, or the latest Company X marketing jingle.

It should be noted that embodiments do not require three separate messages or three separate positions. Embodiments may only utilize two separate messages at two separate positions. Further embodiments may utilize more than three message positions. Embodiments may also use the same message but transmitted to several different positions so that the chance of catching a passing consumer is increased.

Figure 2:
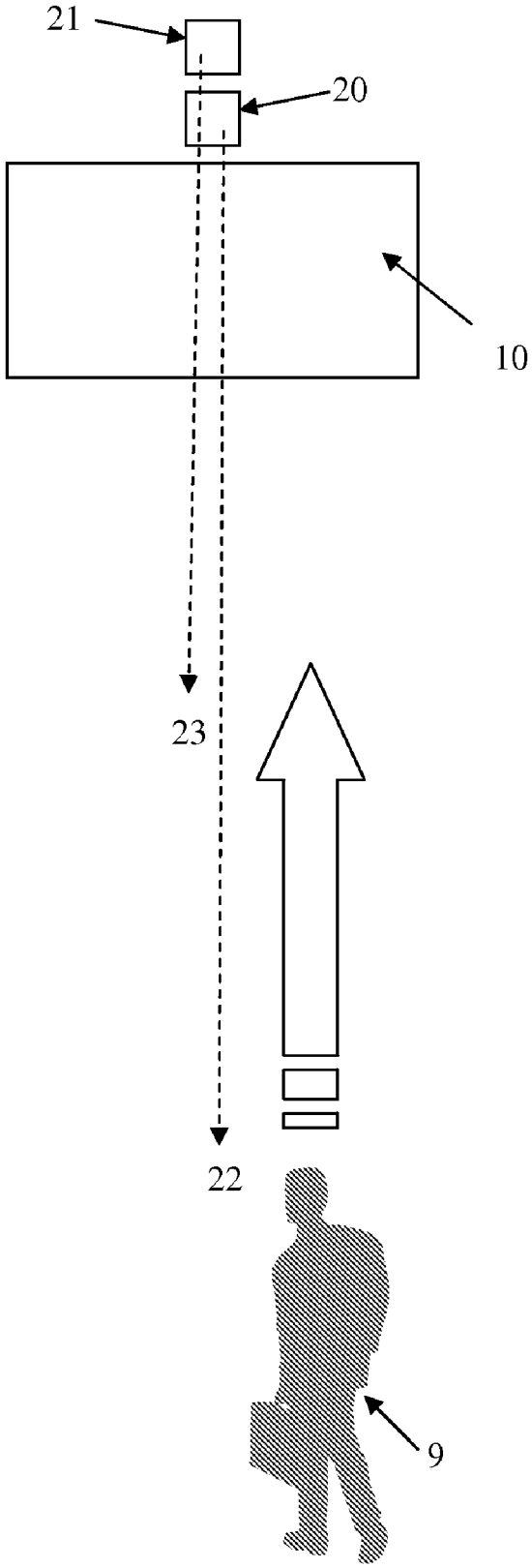
FIG. 2 is a schematic illustration of an embodiment where two different sound messages are projected at two different distances from a display.

In FIG. 2, the display 10 is shown with two sound focusing devices 20 and 21. In this embodiment, a first sound message may be transmitted to position 22 and a second sound message may be transmitted to position 23. As discussed above, the message transmitted to position 22 may be the attention grabbing message and may instruct the consumer to step towards the display if they would like to hear more about the advertiser's product or services. If the consumer is interested, by stepping into position 23 the consumer may hear a longer, more detailed message regarding the advertiser's products, services, or contact information.

Further, as mentioned above, the display 10 may have touch-screen technology such that once the consumer is drawn into the closer position 23 they may select from various icons on the touch-screen for different graphics, video, and/or audio messages. For example, a restaurant may display various menu items, and by selecting an item through the touch-screen a message may be transmitted which gives a description of the menu item. Further, car dealerships may display pictures of various vehicles and a selection of a specific vehicle may transmit a message describing various features of the vehicle. Still further, grocery stores may display several items on sale and by selecting an item a message may be transmitted which details the location of the item within the store. This touch-screen methodology can be utilized with any embodiment.

Figure 3:
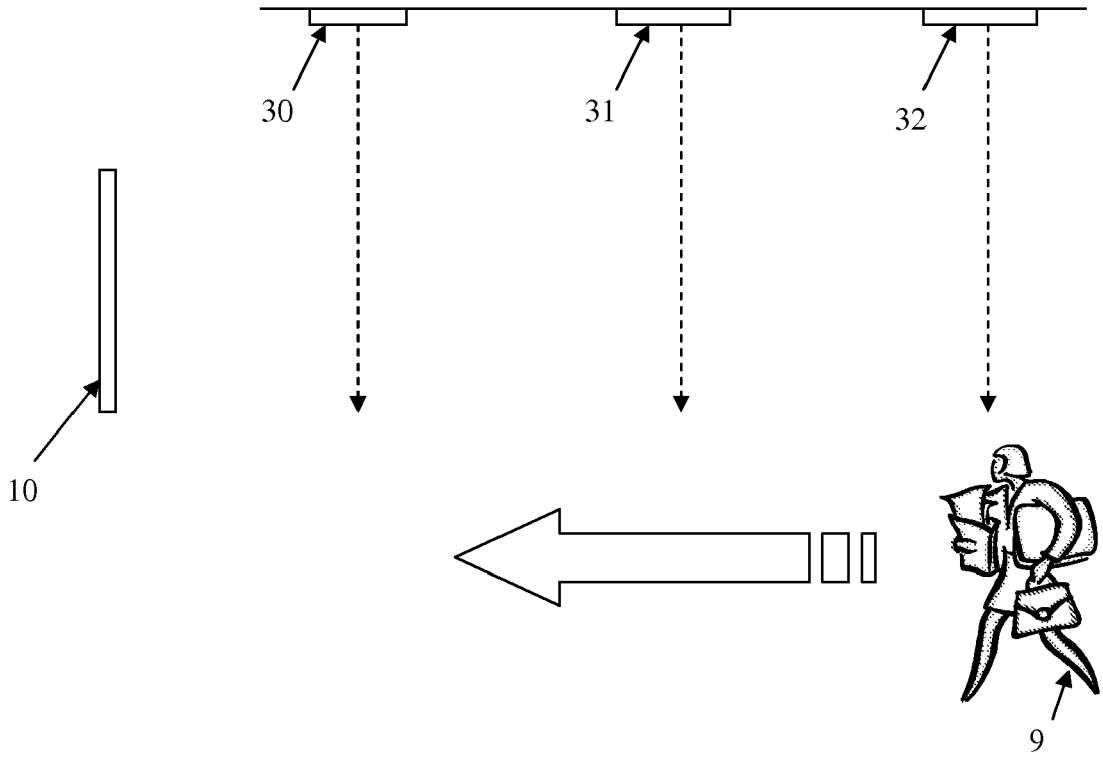
FIG. 3 is a schematic illustration of an embodiment where three different sound messages are projected at three different distances from a display and the messages originate from above the consumer.

FIG. 3 shows a display 10 with three sound focusing devices 30, 31, and 32 positioned above the consumer 9. This embodiment would function similar to the embodiment shown in FIG. 2, except that three separate messages can be used and the sound focusing devices can be placed above the consumer 9 rather than in front of the consumer and above the display 10. Of course, sound focusing devices could also be placed below the consumer and behind the consumer.

Figure 4:
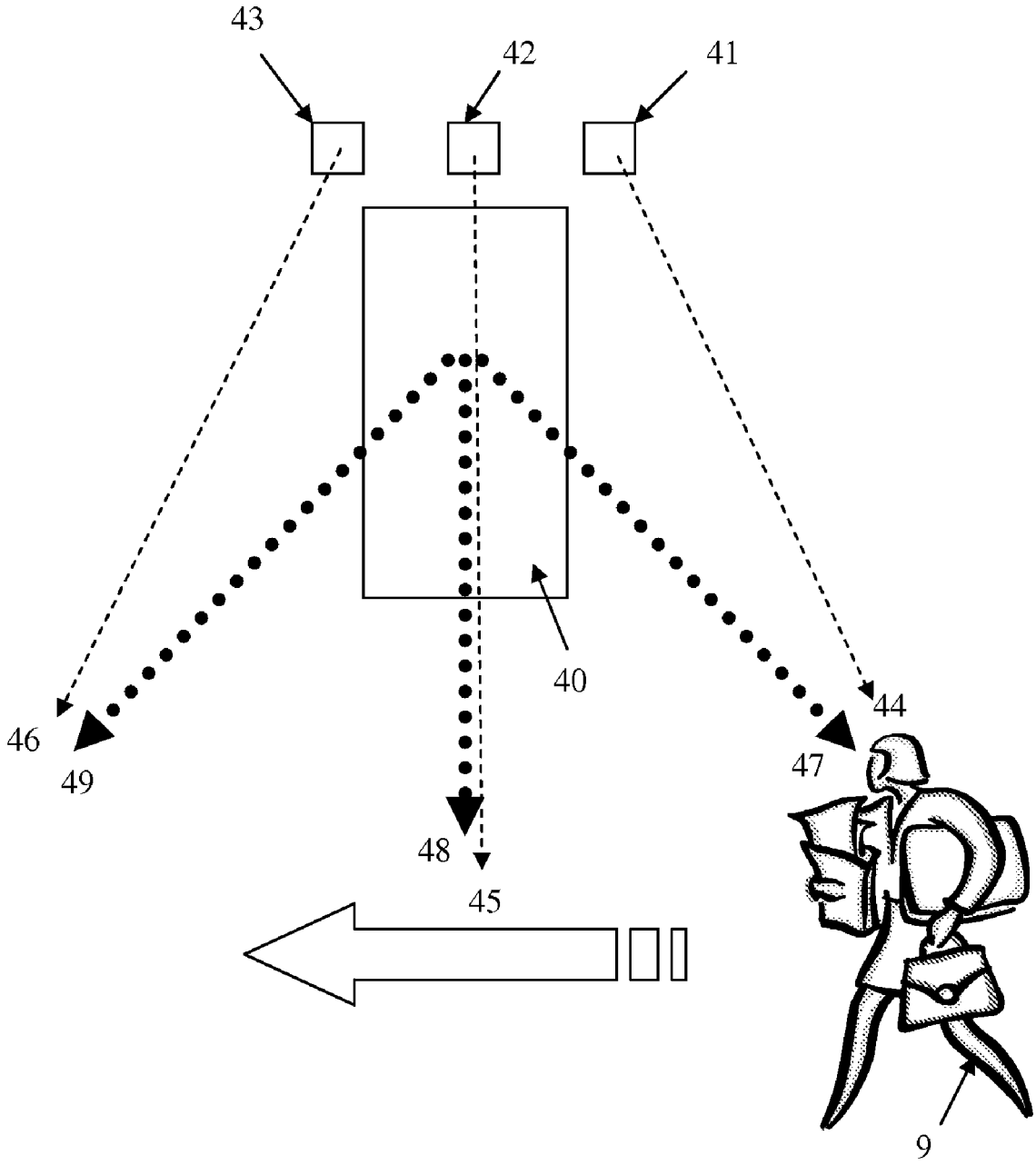
FIG. 4 is a schematic illustration of an embodiment where three different sound messages are projected at three different angles from a display and three different images are shown at three different angles from the display.

FIG. 4 shows an exemplary embodiment where a multi-view display 40 is used to show three different images to three separate positions 47, 48, and 49. A multi-view display is commercially available from Manufacturing Resources International of Alpharetta, Ga.; www.outdoor-displays.com. An exemplary model would be the Triple View Display. This display uses a special layer of glass which contains a thin layer of material deposited on the surface so that only certain pixels of a liquid crystal display are visible at certain angles. This display is capable of showing multiple images simultaneously, depending on the angle of incidence relative to the display.

This embodiment also contains three sound focusing devices 41, 42, and 43. Thus, as the consumer 9 passes the display 40, there may be a first image 47 and a first message 44. Accordingly, as the consumer 9 continues to travel, there may be a second image 48 and a second message 45. Finally, the consumer 9 may see a third image 49 with a third message 46. This embodiment could also show two images and transmit two messages rather than three separate images and three separate messages.

Figure 5:
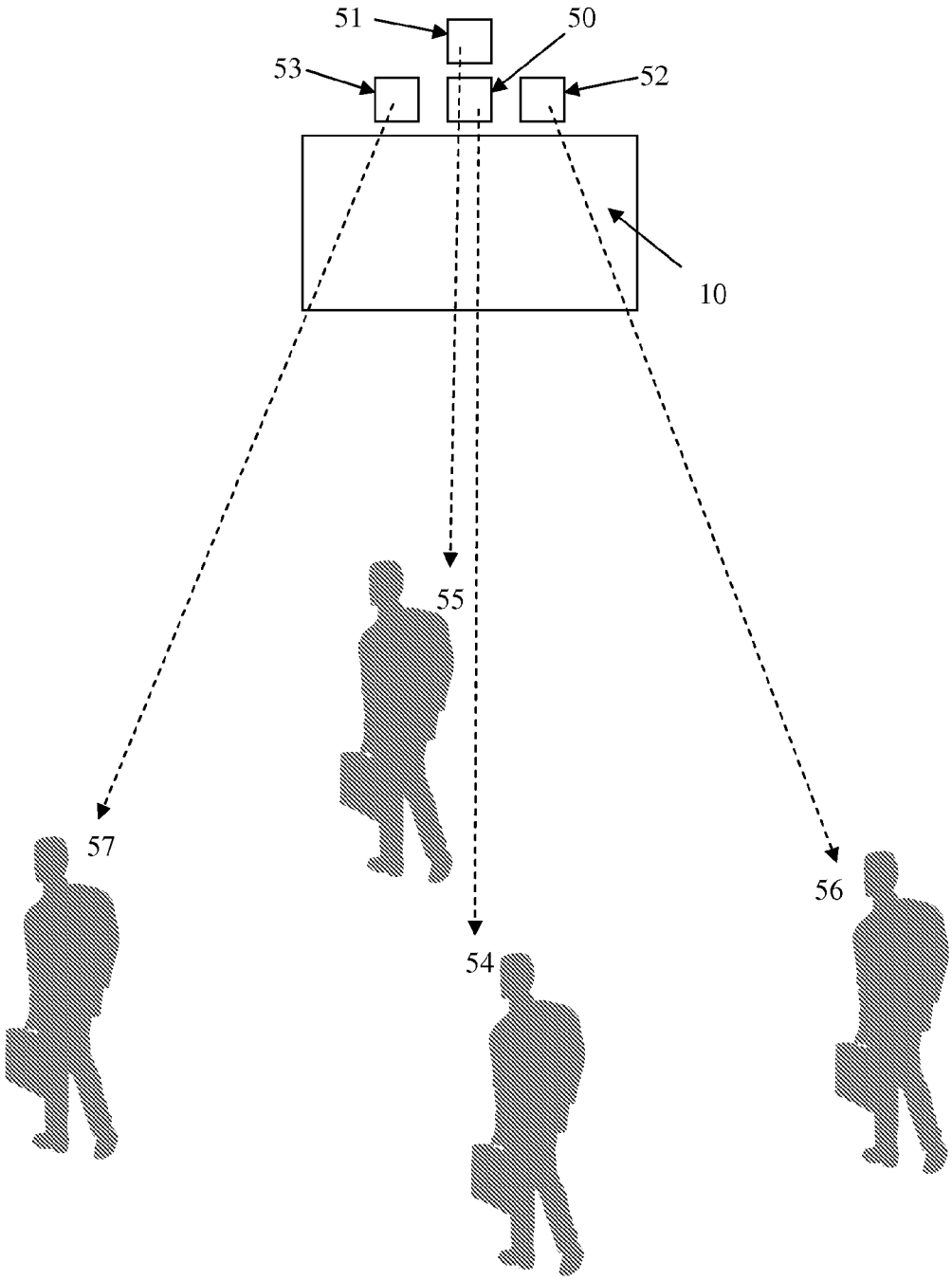
FIG. 5 is a schematic illustration of an embodiment showing a plurality of sound messages projected to a plurality of different positions simultaneously.

FIG. 5 is a schematic which clarifies that embodiments may transmit the messages simultaneously to several consumers at different positions. These messages may be different from each other, or they may be the same message transmitted to several different positions. In this figure, sound focusing devices 50, 51, 52, and 53 transmit sound messages to positions 54, 55, 56, and 57 respectively. Clearly, any number of sound focusing devices may be utilized to transmit messages to any number of positions. With this embodiment, each consumer is within their own personal 'sound zone' where messages can be heard without affecting others. As consumers walk through the various positions their attention will be directed towards the display 10.

To increase the effectiveness of all the disclosed embodiments, positional sensors (not shown) may be used to detect when a consumer is within the desired position. This may be beneficial for a number of reasons. First, consumers will receive messages from their intended beginnings. For example, without positional sensors, a consumer may walk into the middle of a message and become confused or irritated. The use of positional sensors also allows an extended message to play when the consumer remains in the desired position. Thus, if a longer message is desired by the advertiser, a positional sensor can ensure that the entire message will not play unless the consumer remains in the desired position. Without positional sensors, long messages may be resisted by advertisers due to the risk that was discussed above where consumers may enter during the middle or end of a long message and become confused or irritated. Positional sensors may also be used with the display to begin a video segment or begin a series of static images once a consumer is in the desired viewing position. The use of positional sensors can create a more interactive consumer experience.

It should be noted that these positional sensors are by no means required. In some situations they may be difficult to use, especially where there is a high volume of consumer traffic in front of the display. In these situations, re-starting the message every time a positional sensor is tripped might irritate consumers who have remained in the same position and want to hear the entire message. Positional sensors may have the most benefit when they are used in low volume consumer traffic areas and there is a desire to provide a more interactive and 'attention-grabbing' experience. However, proper orientation of the positional sensors and synchronization with the sound focusing devices may still provide a beneficial use for positional sensors in high traffic areas.

It should also be noted that the messages described herein can be any audible sound including, but not limited to: speech, sound effects, music, and any combination of these.

Having shown and described preferred embodiments, those skilled in the art will realize that many variations and modifications may be made to affect the described embodiments and still be within the scope of the claims. Thus, many of the elements indicated above may be altered or replaced by different elements which will provide the same result and fall within the spirit of the claimed embodiments. It is the intention, therefore, to limit the invention only as indicated by the scope of the claims.

What is claimed is:

1. A multi-sound multi image information system for use with a liquid crystal display (LCD) having a plurality of pixels arranged in vertical rows, where every third vertical row comprises a grouping of pixels so that the entire LCD is divided into three vertical groupings of pixels; a semi-transparent plate in front of the LCD; a plurality of vertical lines placed on the plate which permit the first grouping of pixels to be viewed only from a first viewing position, permit the second grouping of pixels to be viewed only from a second viewing position, and permit the third grouping of pixels to be viewed only from a third viewing position; the system comprising:

a first sound focusing device adapted to transmit a first message to the first viewing position;

a second sound focusing device adapted to transmit a second message to the second viewing position; and a third sound focusing device adapted to transmit a third message to the third viewing position.

2. The system of claim 1 wherein:

said sound focusing devices comprises an array of loudspeakers.

3. The system of claim 1 wherein:

said sound focusing devices comprise parametric audio amplifier systems.

4. The system of claim 1 wherein:

said sound focusing devices transmit said messages using a carrier signal with a frequency above 20 k Hz.

5. The system of claim 1 further comprising:

a positional sensor operatively connected to each sound focusing device and adapted to sense the presence of a consumer within one of said viewing positions.

6. A multi-sound multi-image information system for use with a liquid crystal display (LCD) having a plurality of pixels divided into first and second pixel groups and a transparent substrate placed in front of the LCD and containing a plurality of vertical lines which block the second pixel group but allow transmission of the first pixel group when viewed from a first position and block the first pixel group but allow transmission of the second pixel group when viewed from a second position, the system comprising:

a first sound focusing device placed adjacent to the LCD which transmits a first message to the first position; and a second sound focusing device placed adjacent to the LCD which transmits a second message to the second position, where the second position is at least two feet from the first position.

7. The system of claim 6 wherein:

said sound focusing devices comprises an array of loudspeakers.

8. The system of claim 6 wherein:

said sound focusing devices comprise parametric audio amplifier systems.

9. The system of claim 6 wherein:

said sound focusing devices transmit said messages using a carrier signal with a frequency above 20 k Hz.

10. The system of claim 6 further comprising:

a first positional sensor operatively connected to the first sound focusing device and adapted to sense the presence of a consumer within the first position; and a second positional sensor operatively connected to the second sound focusing device and adapted to sense the presence of a consumer within the second position.

11. An advertising method for use with a liquid crystal display (LCD) having a plurality of pixels arranged in vertical rows, where every third vertical row comprises a grouping of pixels so that the entire LCD is divided into three vertical groupings of pixels, a transparent substrate placed in front of the LCD and having a plurality of vertical lines which cause the first grouping of pixels to be viewed only from a first viewing position, the second grouping of pixels to be viewed only from a second viewing position, and the third grouping of pixels to be viewed only from a third viewing position, the method comprising the steps of:

transmitting a first focused message to the first viewing position;

transmitting a second focused message to the second viewing position; and transmitting a third focused message to the third viewing position.

12. The advertising method of claim 11 further comprising:

sensing the presence of a consumer within the first viewing position prior to transmitting the first focused message.

13. The advertising method of claim 11 wherein:

said steps of transmitting focused messages is performed by an array of loudspeakers.

14. The advertising method of claim 11 wherein:

said steps of transmitting focused messages is performed by parametric audio amplifier systems.

15. The advertising method of claim 11 wherein:

said steps of transmitting focused messages is performed by transmitting said messages using a carrier signal with a frequency above 20 kHz.

* * * * *